US007275581B2

(12) United States Patent
Coenraets

(10) Patent No.: US 7,275,581 B2
(45) Date of Patent: Oct. 2, 2007

(54) DEVICE WITH SHUTTER WINDING ABOUT A DRUM

(75) Inventor: Benoit Coenraets, Brussels (BE)

(73) Assignee: Dynaco International, S.A., Brussels (BE)

( * ) Notice: Subject to any disclaimer, the term of this patent is extended or adjusted under 35 U.S.C. 154(b) by 190 days.

(21) Appl. No.: 10/517,376

(22) PCT Filed: Jun. 13, 2003

(86) PCT No.: PCT/BE03/00106

§ 371 (c)(1),
(2), (4) Date: Dec. 10, 2004

(87) PCT Pub. No.: WO03/106801

PCT Pub. Date: Dec. 24, 2003

(65) Prior Publication Data

US 2006/0037718 A1 Feb. 23, 2006

(30) Foreign Application Priority Data

Jun. 13, 2002 (BE) ..... 2002/0387

(51) Int. Cl.
*E06B 9/56* (2006.01)

(52) U.S. Cl. ..... 160/273.1; 160/237; 160/242

(58) Field of Classification Search ..... 160/268.1, 160/269, 270, 271, 273.1, 243, 264, 242, 160/237

See application file for complete search history.

(56) References Cited

U.S. PATENT DOCUMENTS 1,138,668 A * 5/1915 Knapp ..... 160/27
1,612,261 A * 12/1926 Burns ..... 160/273.1
3,900,063 A 8/1975 Roller
4,064,648 A 12/1977 Cary
4,390,054 A 6/1983 Niibori et al.
4,436,137 A * 3/1984 Charles ..... 160/242
4,565,231 A 1/1986 Moessner et al.
4,921,033 A 5/1990 Finch et al.
5,307,859 A * 5/1994 Kraeutler ..... 160/264
5,482,104 A * 1/1996 Lichy ..... 160/273.1
5,785,105 A * 7/1998 Crider et al. ..... 160/243

FOREIGN PATENT DOCUMENTS

FR 1 384 797 A 1/1965
JP 2000160960 A 6/2000

* cited by examiner

*Primary Examiner*—David Purol
(74) *Attorney, Agent, or Firm*—Browdy and Neimark, PLLC

(57) ABSTRACT

A shutter device co-operating with driving means for enabling the shutter (1) to be displaced between an open position and a closed position, this shutter (1) being guided by a guide track (4, 5) and being designed to close off a bay (6) or other opening. The device having a drum (8) about which the shutter (1) is wound when the latter is in the open position such that the shutter forms a roll (31) made up of turns formed by successive layers of the shutter (1). The shutter (1) can be unwound from this roll towards its closed position. The device further has confining means for preventing the turns from forming wrinkles as the shutter (1) is being displaced into the closed position and/or for preventing these turns from slipping relative to one another.

21 Claims, 14 Drawing Sheets

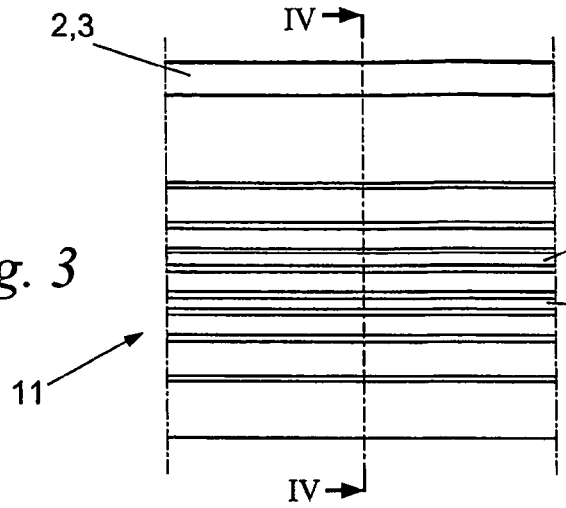
Fig. 3
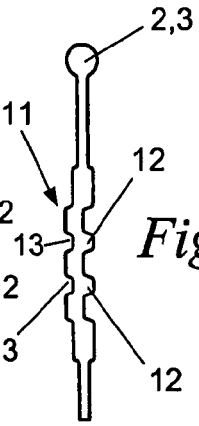
Fig. 4
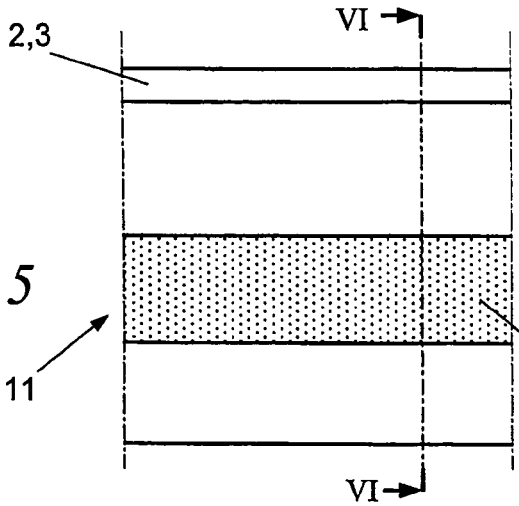
Fig. 5
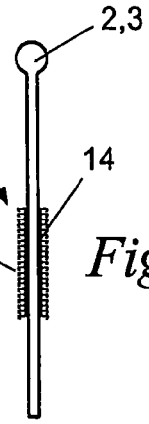
Fig. 6
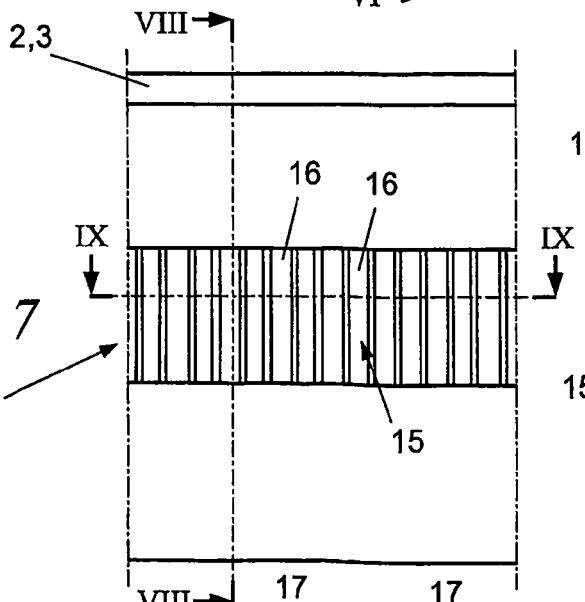
Fig. 7
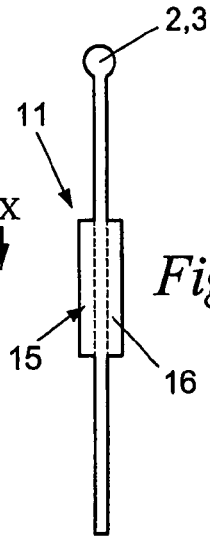
Fig. 8
Fig. 9
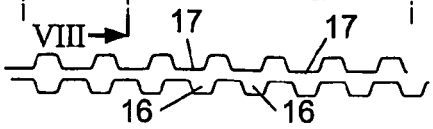

DEVICE WITH SHUTTER WINDING ABOUT A DRUM

The invention relates to a shutter device co-operating with driving means to enable the shutter to be displaced between an open position and a closed position, this shutter being designed to close off a bay or another opening. The device comprises a drum, about which the shutter is wound when in its open position, forming a roll made up of turns consisting of successive superposed layers of the shutter, which can be unwound from the drum into its closed position.

In existing devices of this type known to date, the shutter is unwound by rotating the drum about its axis so that the shutter is lowered in order close off the bay, the side edges thereof preferably being guided in two guide tracks extending parallel with one another. A thrust force is exerted on the side edges of the shutter, running in the longitudinal direction, as the drum is rotated.

This prior art has several disadvantages. Firstly, the roll which forms as the shutter is opened has been found to be very bulky and is often very irregular.

Secondly, as the shutter is being closed, the part of the shutter located above the top end of the guide tracks may be susceptible to puckering in the region of the drum. This can seriously hamper normal operation of the device.

Thirdly, it has been found that the surface of the shutter starts to become scratched after the shutter has been opened and shut a certain number of times. This is a particular disadvantage if the shutter has one or more windows, which cease to be transparent after a certain length of time.

The objective of the invention is to overcome these disadvantages by proposing a shutter device which is opened and closed in a controlled manner, guaranteeing that the shutter will form a very regular roll as it is opened and that it will be unwound without the shutter puckering upstream of the guide tracks. More specifically, the purpose of the invention is to propose a device whereby the shutter forms superposed layers of very regular and uniform turns as it is wound around the drum.

To this end, confining means are provided, which prevent the turns from puckering as the shutter is displaced into the closed position and/or prevents these turns from slipping relative to one another.

Advantageously, the confining means consist of hooking means extending along the length of the shutter, at least on one of the faces thereof, these hooking means fixing the successive turns relative to one another to prevent the successive layers of the wound shutter from slipping relative to one another.

Advantageously, the hooking means consist of a strip, preferably of a flexible material, extending across at least one of the two faces of the shutter along the length thereof, this strip possibly being provided with at least one projection which co-operates with the corresponding part on the other face of the shutter, so that said projection grips with this part when the shutter is wound around the drum.

For practical purposes, the hooking means consist of a ribbon provided with hooks extending on either side of the plane of the shutter so that the hooks on one side of the shutter can grip onto the hooks on the other side of the shutter as it is being wound.

In one advantageous embodiment of the device proposed by the invention, at least one pressing element is provided, which applies an essentially radial thrust force to the hooking means relative to the drum in order to fix the successive turns of the roll one to the other.

In one specific embodiment of the device proposed by the invention, the confining means consist of a belt at least partially enclosing said roll and exerting a compression force on the roll, means being provided to adapt the shape of this belt to the diameter of the roll as the shutter is wound or unwound.

In one specific embodiment of the invention, means are provided to exert a traction force on one of the ends of the belt, so that at least a part of the latter extends around the contour of the roll applying a pressing force on it as the shutter is wound or unwound.

In one specific embodiment of the device proposed by the invention, said belt loops back on itself and is guided on cylinders extending substantially parallel with the axis of the drum, said roll being at least partially enclosed by the belt, which is in contact with the outermost turn of the roll and exerts a compression force thereon.

Advantageously, at least one of said cylinders is mounted so as to move relative to the drum in order to adapt the shape of the belt to the diameter of the roll as the shutter is wound or unwound.

Other details and features of the invention will become apparent from the description given below, which is not intended to be restrictive, of several specific embodiments of a shutter device as proposed by the invention, with reference to the appended drawings.

FIG. 3 is a front view of a side edge of a shutter in a first embodiment of the shutter device proposed by the invention.

FIG. 4 is a cross-section of the side edge of the shutter along line IV-IV indicated in FIG. 3.

FIG. 5 is a front view of a side edge of a shutter in a second embodiment of the shutter device proposed by the invention.

FIG. 6 is a cross-section of the side edge of the shutter along line VI-VI indicated in FIG. 5.

FIG. 7 is a front view of a side edge of a shutter in a third embodiment of a shutter device proposed by the invention.

FIG. 8 is a cross-section of the side edge of the shutter along line VIII-VIII indicated in FIG. 7.

FIG. 9 is a cross-section of the side edge of the shutter along the line IX-IX indicated in FIG. 7.

The same reference numbers are used in the different drawings to denote the same or similar elements.

Generally speaking, the present invention relates to a shutter device co-operating with driving means, such as a drum, the axis of which is connected to the shaft of an electric motor. The shutter is displaced in a downward and upward movement between a closed position and an open position respectively and is designed to close off a bay in a wall or a passage, such as a corridor.

The word "shutter" as used in the context of the present invention should be construed as meaning any planar element which is at least partially pliable or flexible, such as a canvas, a strip of plastics material, a metal cover, a trellis, a metal sheet, a mosquito screen, etc. More specifically, it is a shutter which can be wound around a drum, the axis of which is perpendicular to the direction of displacement of the shutter as it is opened.

It should be pointed out, however, that particular preference is given to flexible shutters in the form of a canvas, for example. The appended drawings therefore relate more specifically to such a canvas.

Figure 1:
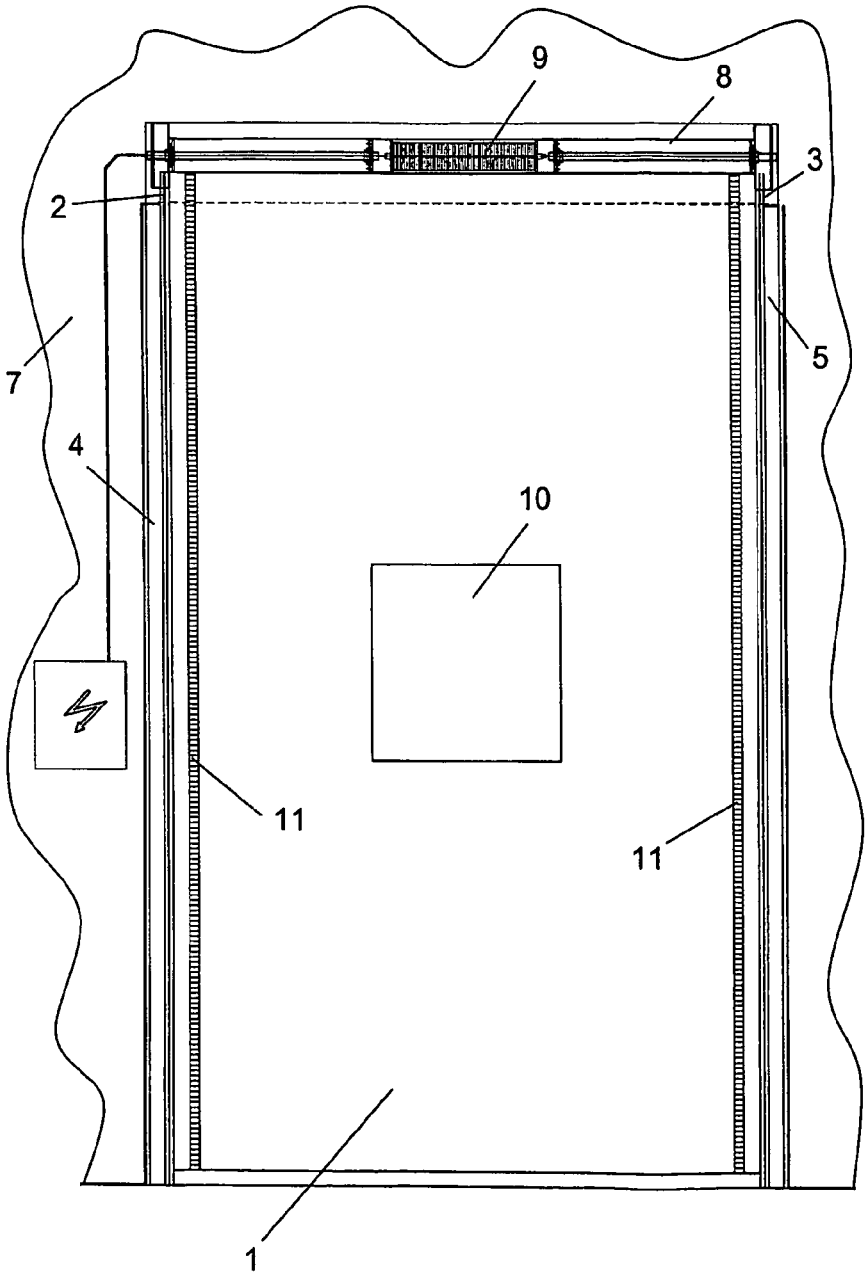
FIG. 1 is a schematic front view of a shutter device where the shutter is in the closed position.
Figure 2:
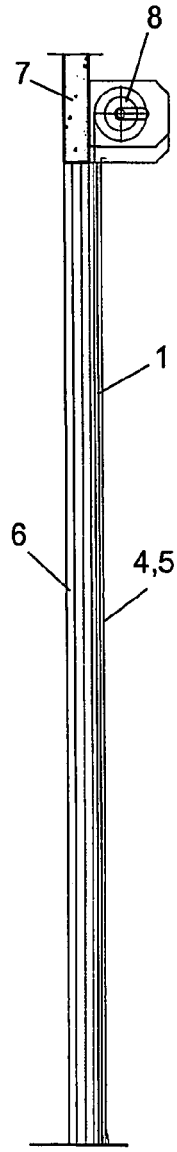
FIG. 2 is a side view of the shutter device illustrated in FIG. 1.

FIG. 1 provides a schematic illustration of the shutter device in the closed position. This device comprises a shutter 1 with side edges 2 and 3 projecting beyond the plane of the shutter 1, which are advantageously provided in the form of a continuous bead or a succession of small blocks articulated one about the other displaced in guide tracks 4 and 5. The guide tracks 4 and 5 are provided at either side of a bay 6 arranged in a wall 7.

Provided above the bay 6 is a drum 8, on which the shutter 1 can be wound. An electric motor 9 is provided inside the drum 8, enabling the drum 8 to be driven about its axis. This enables the shutter 1 to be wound on the drum 8 to bring it into the open position or enables it to be unwound into its closed position. As the shutter 1 is displaced towards its closed position, the side edges 2 and 3 thereof are guided by the guide tracks 4 and 5.

A transparent window 10 is provided at the center of the shutter 1.

As the shutter 1 is opened, it is wound around the drum 8, forming a roll consisting of turns formed by successive superposed layers of the shutter 1.

Confining means are provided for the purposes of the invention, which enable a very compact roll to be obtained in which the successive turns are hold tight one against the other. These confining means therefore prevent wrinkles from forming in the turns of the roll as the shutter 1 is unwound at the instant at which its edges engage in the top end of the guide tracks 4 and 5.

In particular, the confining means consist of hooking means extending along the length of the shutter 1 on at least one of its faces. When the shutter 1 is wound around the drum 8, these hooking means enable the successive turns thereof to be fixed one to the other to prevent the successive layers of the shutter 1 from slipping relative to one another.

A first embodiment of the invention is schematically illustrated in FIGS. 3 and 4. These drawings illustrate a part of the shutter 1 in the region of one of the side edges 2 or 3, provided in the form of a continuous bead. In particular, the shutter 1 has hooking means 11 in the vicinity of side edges 2 and 3, which consist of projections 12 extending along the length of the shutter 1 on one of the faces thereof. As the shutter 1 is being wound, these projections grip in matching recesses 13 provided on the other face of the shutter 1. Consequently, the successive turns of the shutter 1 are fixed to one another as it is around the drum 8.

As a result of a certain amount of friction or a certain adhesion between the projections 12 and the matching recesses 13, the different layers of the shutter 1 forming these turns are not able to slip relative to one another. The projections 12 are, in particular, hold tight in the matching recesses 13 in order to fix the successive turns relative to one another.

By preference, the region of the shutter 1 provided with said projections 12 and matching recesses 13 is provided as a strip of elastomer, such as polyurethane, for example. The fact of choosing an elastomer material specifically improves the hooking action of the projections 12 in the recesses 13.

When the shutter 1 is being closed by rotating the drum 8, the projections 12 are automatically released from the matching recesses 13 as and when the shutter 1 is unwound.

FIGS. 5 and 6 illustrate a second embodiment of the shutter 1 proposed by the invention, in which the hooking means 11 consist of a ribbon 14 provided with hooks. Such a ribbon 14 is provided with hooks of the Velcro 7 type, for example, which is attached to the two faces of the shutter 1 so that when the shutter 1 is wound around the drum 8, the hooks on the ribbon 14 of one of the faces of the shutter grip the hooks of the ribbon 14 provided on the other face of the shutter. The ribbons extend in the longitudinal direction of the shutter 1, close to each of the side edges 2 and 3 of the latter.

Although the ribbons 14 are preferably substantially continuous, it would also be possible to provided an intermittent series of ribbons in the longitudinal direction of the shutter 1.

FIGS. 7 to 9 illustrate a third embodiment of the hooking means proposed by the invention, in which a notched belt 15 is attached to the shutter 1 and extends in the longitudinal direction thereof. Accordingly, one of the sides of the shutter 1 is provided with a series of teeth 16, whilst the other side of the shutter 1 has matching notches 17. As the shutter 1 is wound, the teeth 16 on one side thereof engage in the notches 17 on the other side of the shutter 1, preventing the successive layers of the shutter 1 in the resultant roll from slipping.

In a variation on this embodiment of the invention, the shutter 1 is provided with a succession of teeth along the side edges of the shutter 1 at only one face of the latter. The other face then has a continuous strip, made from an elastically compressible material as for example artificial foam, so that, when the shutter is wound around the drum, the teeth compress this strip locally whereby recesses are formed into which the teeth engage. in this way, the successive turns of the wound shutter can not slip relative to one another.

Figure 10:
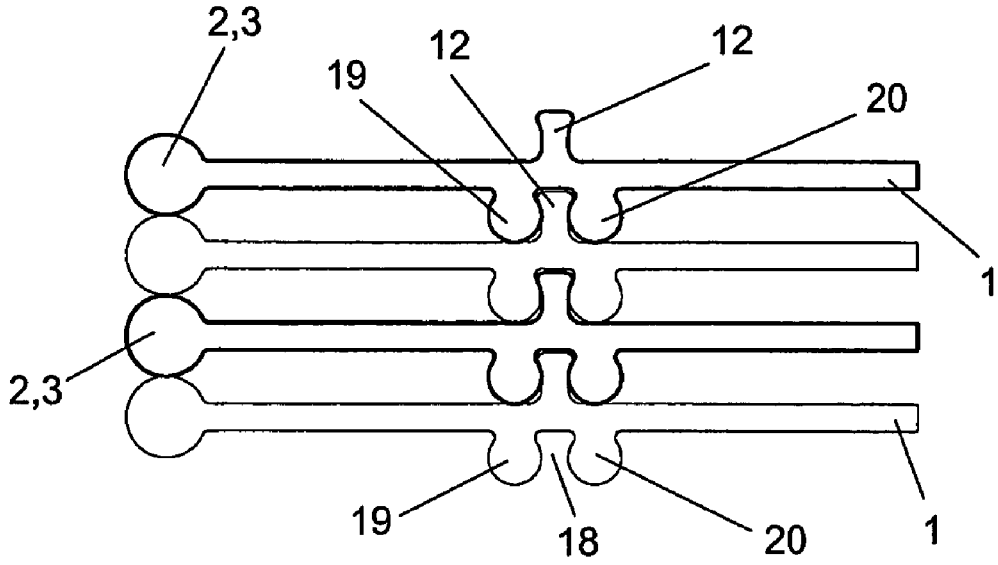
FIG. 10 is a diagram on a larger scale showing a section through several superposed layers of a roll formed by the wound shutter, in a fourth embodiment of the shutter device proposed by the invention.

FIG. 10 shows a cross-section of the successive layers of a shutter 1 which is wound around a drum 8, in a fourth embodiment of the hooking means proposed by the invention. In this embodiment, the hooking means consist of a projection 12, which is attached to the shutter 1 and extends in the longitudinal direction of the shutter 1 close to its side edge 2 or 3. In particular, the projection 12 extends on one side of the shutter 1 parallel with the side edges 2 and 3 of the shutter 1 and co-operates with a groove 18 delimited by two ribs 19 and 20 of circular cross section which are provided on the other side of the shutter 1 and also extend in the longitudinal direction of the shutter 1 and parallel with the side edges 2 and 3.

The section of the base of the projection 12 close to the surface of the shutter 1 is smaller than the section of the top part, so that this projection 12 can be clamped in the groove 18 between the ribs 19 and 20 as the shutter 1 is wound. To this end, the ribs 19 and 20 may be elastically deformed as the projection 12 is introduced into the groove 18.

In particular, when winding up the shutter 1, the projection 12 is gradually clamped into the groove 18 between the ribs 19 and 20. Simultaneously, these ribs 19 and 20 are approaching one to another with respect to their base 48 and the upper part of the projection 12 gets wider and is flattened somewhat while the curvature of the shutter 1 increases. In this way, the projection 12 is wedged between the ribs 19 and 20 in the groove 18, thus fixing the successive turns of the shutter 1 one against another.

When the shutter 1 is displaced towards its closed position, the shutter 1 gradually stretches in the region where it is unwound from the drum 8. In that region, the ribs 19 and 20 and the projection 12 return to their original form, such that the projection 12 is able to release from the ribs 19 and 20.

In this embodiment proposed by the invention, the side edges 2 and 3 are part of a continuous strip 49 extending along the shutter 1, presenting as well the ribs 19 and 20 and the projection 12. This strip 49 is preferably made from an elastomeric material, such as, for example, polyurethane. Such a strip 49 is fixed at each side of flexible canvas so as to form the shutter 1.

Figure 11:
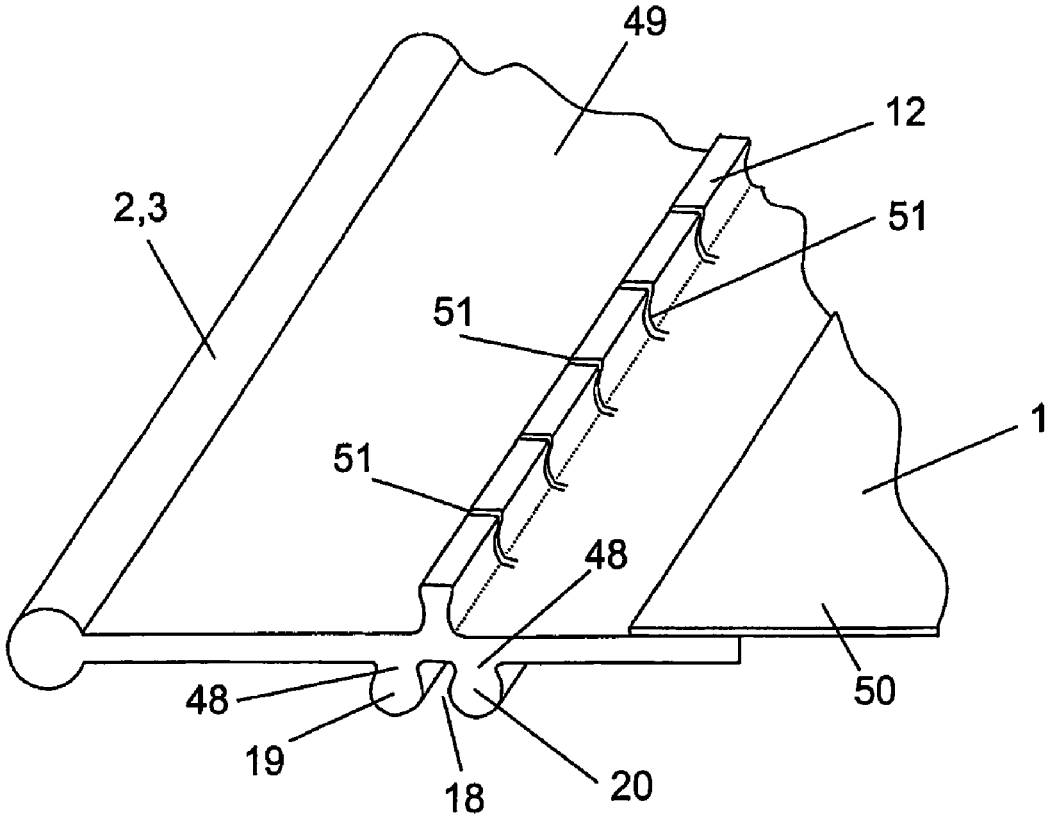
FIG. 11 is a perspective view of a part of the side edge of the shutter indicated in FIG. 10.

As illustrated in FIG. 11 the projection 12 is, by preference, provided with a series of notches 51 transversally extending to the longitudinal direction of the projection. These notches 51 are spaced out with regular distances and avoid that cracks are formed in this projection 12 as the shutter 1 is wound up. This projection 12 is, preferably, provided at the side of the shutter 1 that corresponds to the outer face of the turns formed when the shutter 1 is wound up.

Figure 12:
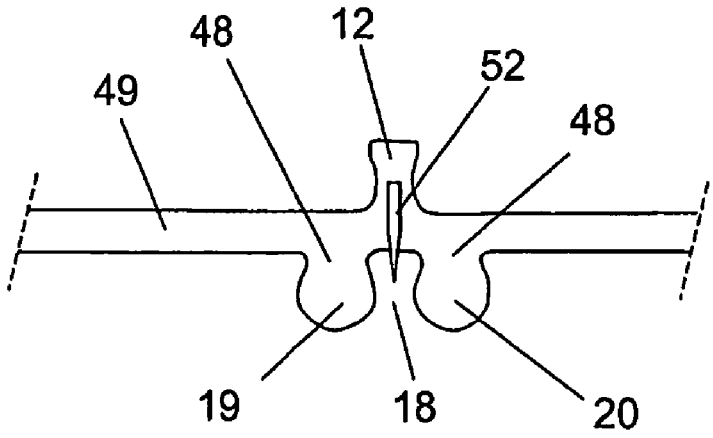
FIG. 12 is a view analogous to that of FIG. 10 of a variant of the embodiment of the invention indicated in FIGS. 10 and 11.

In a variation on this embodiment proposed by the invention, as illustrated in FIG. 12, sharp stems 52, extending transversally to the plane of the shutter 1, are provided in the projection 12. These stems 52 extend with their pointed end into the groove 18 so that, as the projection 12 engages into this groove 18 when the shutter 1 is wound up, the stems 52 penetrate into the upper part of the projection 12 of the preceding turn. In this way, the successive turns of the wound shutter 1 are hooked firmly the one onto the other and can not slip relative to one another. This allows wounding the shutter 1 from its open position by exerting a thrust force onto the side edges 2 and 3 of the shutter 1 along their longitudinal direction in the guide tracks 4 and 5 in order to displace the shutter 1 towards its closed position. In this embodiment proposed by the invention, the shutter 1 can have very large dimensions.

It is clear that it is also possible to provide several projections 12, extending the one near the other at one face of the shutter 1, which are cooperating with a number of matching grooves 18 formed between the ribs 19 and 20 provided on the other face of the shutter 1.

Figure 13:
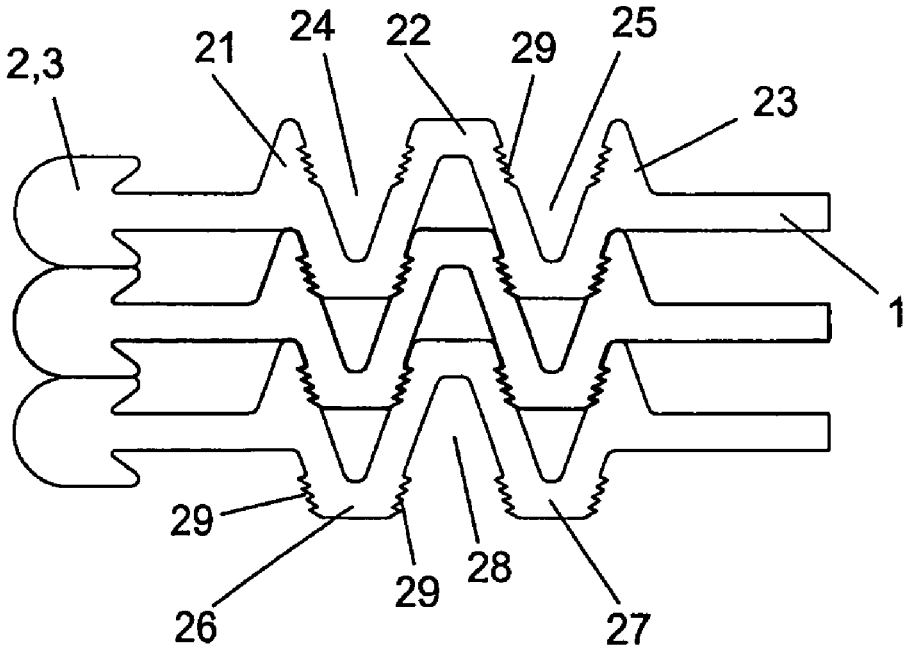
FIG. 13 is a diagram on a larger scale showing a section through several layers of a roll formed by the wound shutter, in a fifth embodiment of the shutter device proposed by the invention.

FIG. 13 illustrates a fifth embodiment of the hooking means proposed by the invention. This drawing shows a cross-section of a part of the successive layers of the shutter 1 formed as it is wound around the drum 8.

Close to the side edges 2 and 3, the shutter 1 has a W-shaped section, thereby defining three ribs 21, 22 and 23 on one side of the shutter 1, extending parallel with one another in the longitudinal direction of the shutter 1. Grooves 24 and 25 are formed between these ribs 21, 22 and 23. The other side of the shutter 1 has two ribs 26 and 27 which match the grooves 24 and 25. A groove 28 extends between the latter ribs 26 and 27.

As the shutter 1 is wound, the ribs 21, 22 and 23 and the grooves 24 and 25 on one side of the shutter 1 engage respectively with the groove 28 and the ribs 26 and 27 on the other side of the shutter 1. This produces a very compact roll in which the successive turns of the shutter 1 are not able to slip relative to one another.

Teeth 29 are provided in the region where the ribs 21, 22 and 23 and the grooves 24 and 25 on one side of the shutter 1 are in contact respectively with the groove 28 and ribs 26 and 27 on the other side of the shutter 1 as it is being wound. Consequently, as the shutter 1 is wound, the teeth 29 on one side of the shutter 1 grip with the teeth 29 on the other side of the shutter 1. These teeth 29 specifically form a barbed region within said grooves and on said ribs.

The region of the shutter 1 having the W-shaped section is preferably made from an elastomer material such as polyurethane, for example, which is sufficiently rigid to be able to hold said ribs in the matching grooves.

Figure 15:
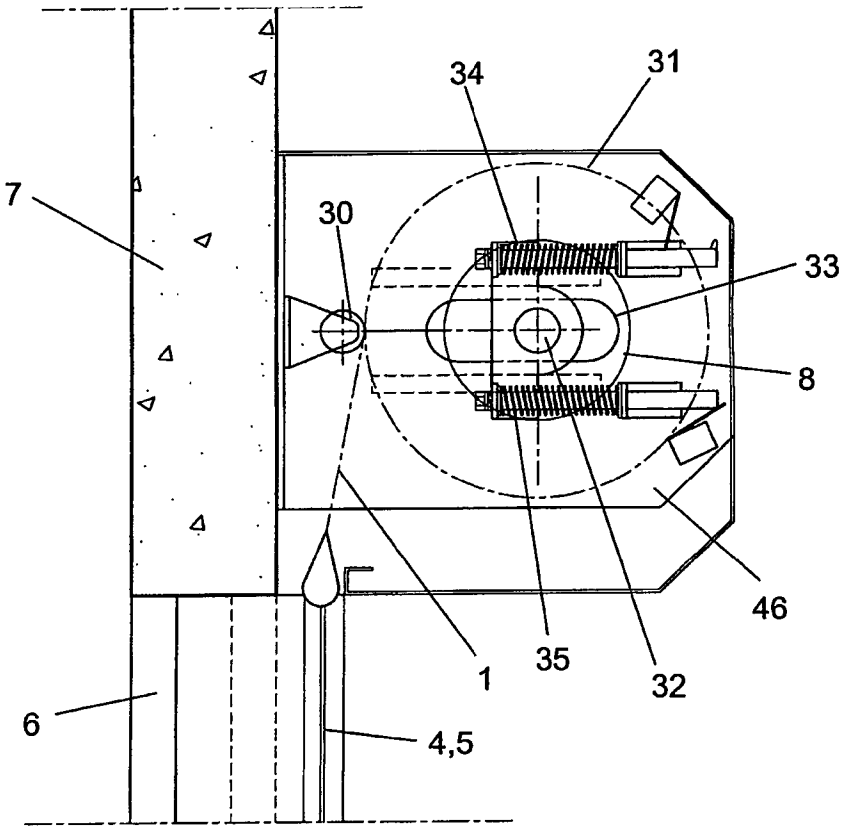
FIG. 15 is a section corresponding to that of FIG. 14, with the shutter in the open position.
Figure 14:
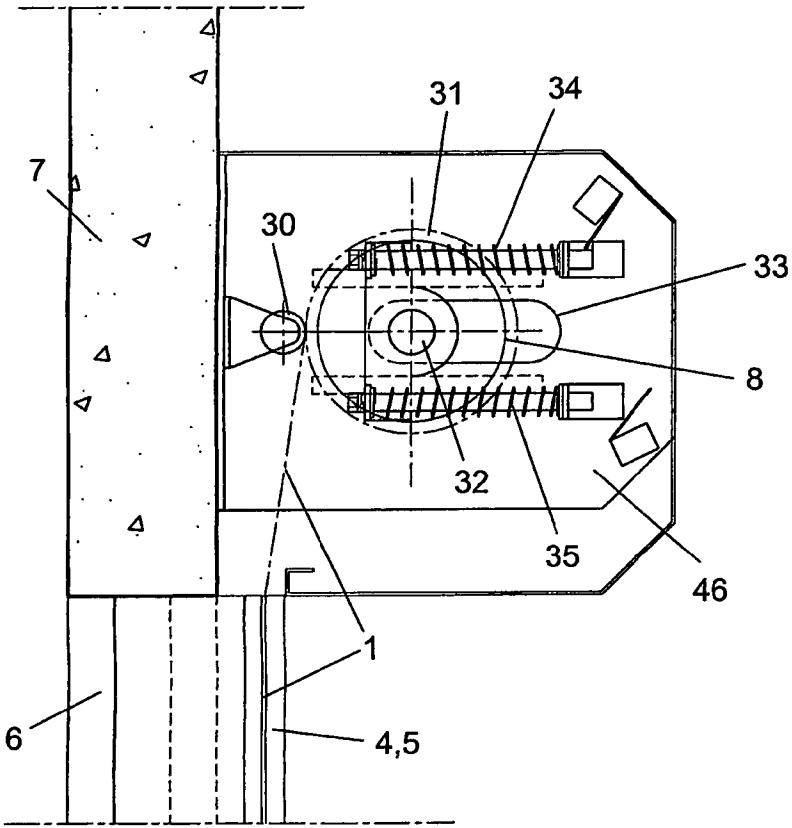
FIG. 14 is a schematic cross-section of a drum with a compressor element when the shutter is in the closed position, in one specific embodiment of the invention.
Figure 16:
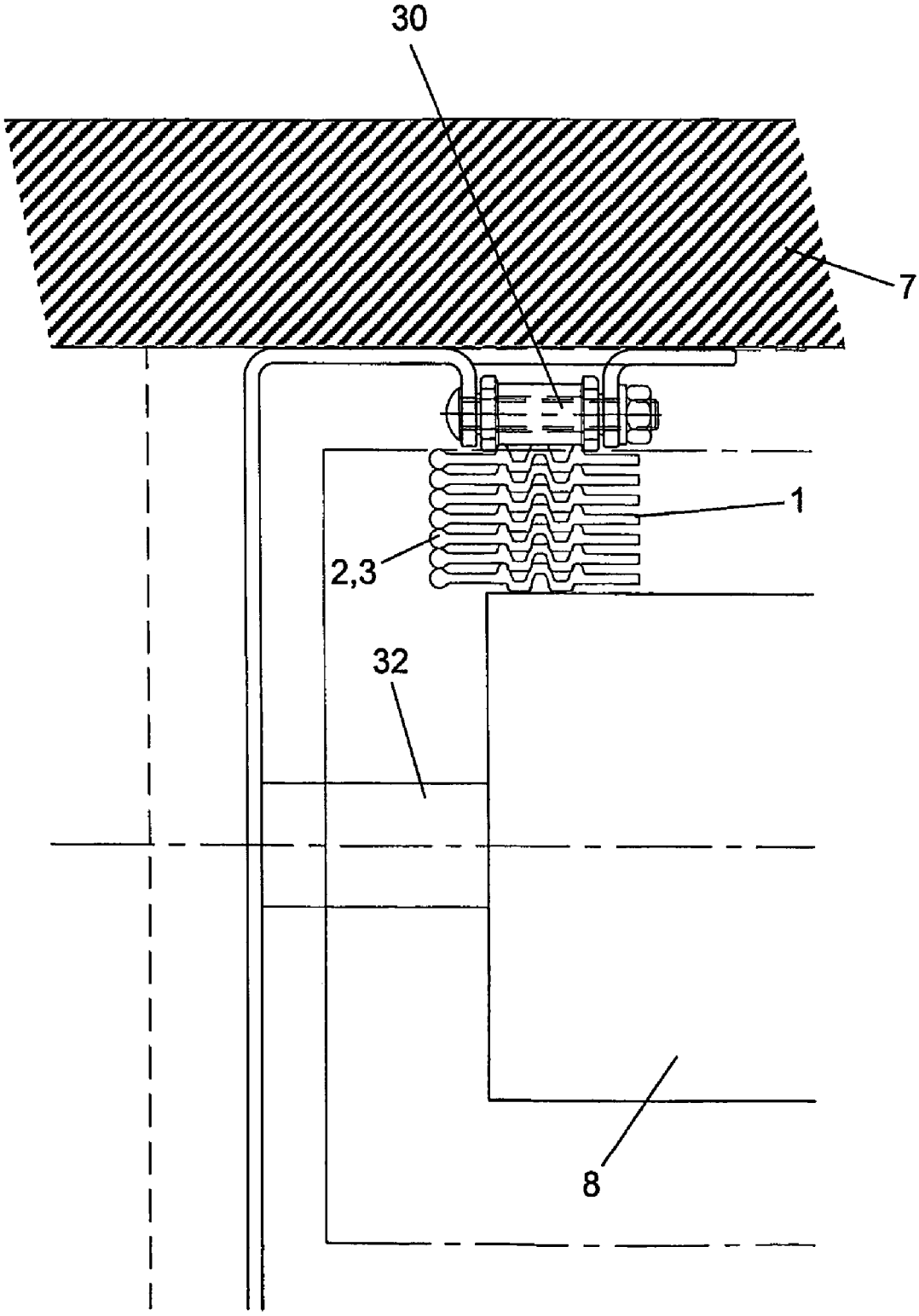
FIG. 16 is a schematic horizontal section along line XIV-XIV indicated in FIG. 15.

In one specific embodiment of the invention, a pressing element is provided, which enables a thrust force to be exerted on the hooking means in order to fix the successive turns of the shutter 1 to one another as the latter is being wound round the drum 8. This is schematically illustrated in FIGS. 14 to 16. The shutter 1 is held tight between the part of the shutter 1 which has already been wound onto this drum 8, forming a roll 31, and the pressing element.

This pressing element specifically consists of a rotating compressor cylinder 30, the axis of which is substantially parallel with the axis of the drum 8. This cylinder 30 is provided in the region where the surface of the part of the shutter 1 that has not yet been wound comes into contact with the part of the shutter 1 already forming turns around the drum 8 as the shutter 1 is being wound. Consequently, the turns of the roll 31 are also unwound in this region and the hooking means are released as the shutter 1 is unwound into its closed position.

Since the diameter of the roll 31 varies as the shutter 1 is wound or unwound, the compressor element 30 and the drum 8 are mounted so as to move relative to one another. In particular, means are provided in order to maintain a pressing force between the roll 31 and the pressing cylinder 30.

As illustrated in FIGS. 14 and 15, the rotating pressing cylinder 30 is fixedly mounted to the wall 7 above the bay 6, whilst the shaft 32 of the drum 8 can be displaced in a horizontal direction in a horizontal guide 33 provided in a casing 46 of the device at each of the ends of the shaft 32.

The drum 8 co-operates with two helical compression springs 34 and 35, one end of which is fixed to the drum 8 and the other end of which is mounted on said casing 46. These springs 34 and 35 extend substantially parallel with the guide 33. Consequently, the drum 8 is displaced in the direction of this slide 33 as the shutter is wound or unwound, to ensure that a pressing force is maintained between the drum 8 or the roll 31 on the one hand and the pressing cylinder on the other.

FIG. 16 is a schematic diagram of the pressing cylinder 30 where the shutter 1 is provided with hooking means similar to those illustrated in FIG. 13. As a result of the thrust force exerted by the cylinder 30 on the shutter 1, the ribs are located in the matching grooves in order to fix the successive turns of the shutter 1 to one another.

The hooking means 11 must be such that the superposed turns of a shutter 1 wound onto a drum 8 are fixed to one another but these turns are automatically released from one another as and when the drum 8 is rotated in the direction opposite that in which the shutter 1 is wound onto the drum 8.

Figure 19:
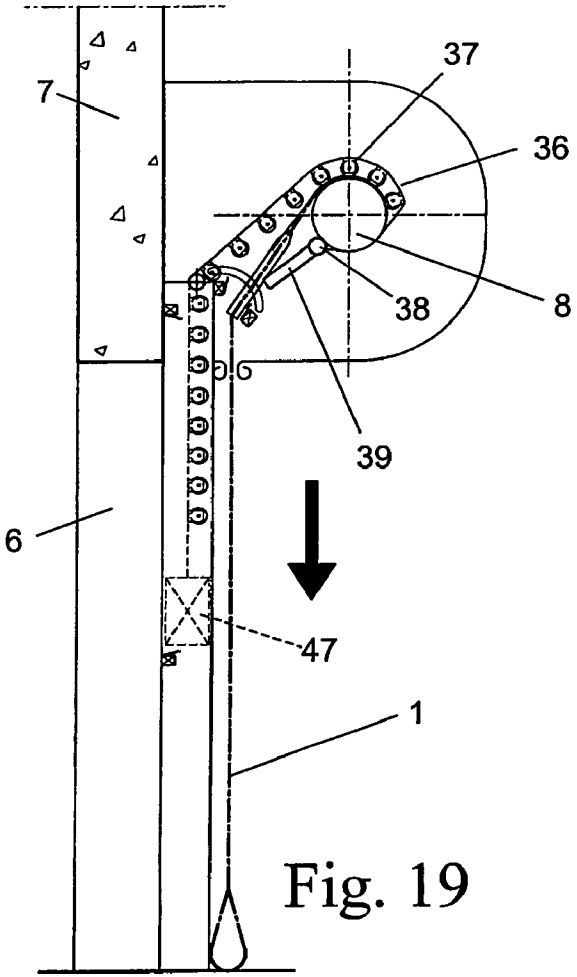
FIG. 19 is an identical view to that of FIG. 17 with the shutter in the closed position.
Figure 18:
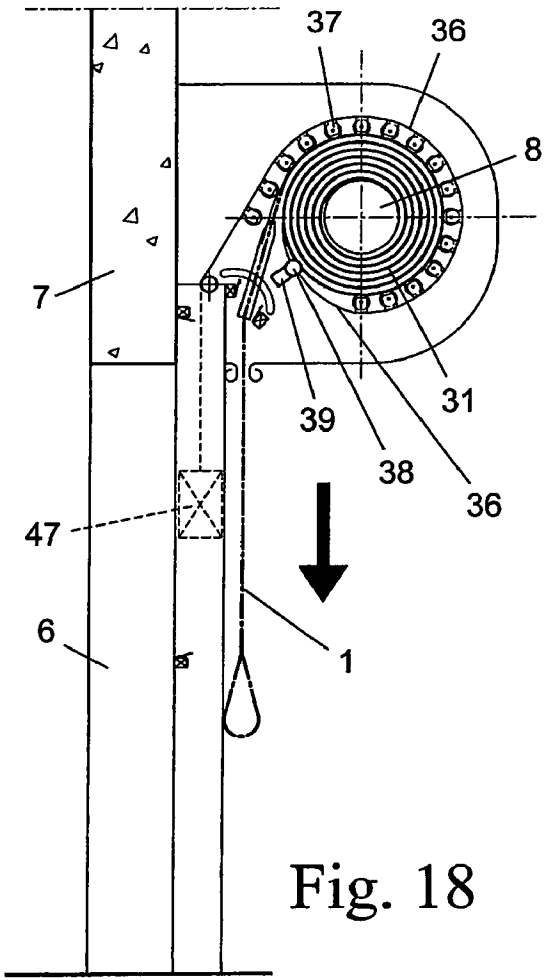
FIG. 18 is an identical view to that of FIG. 17 as the shutter is being closed.
Figure 17:
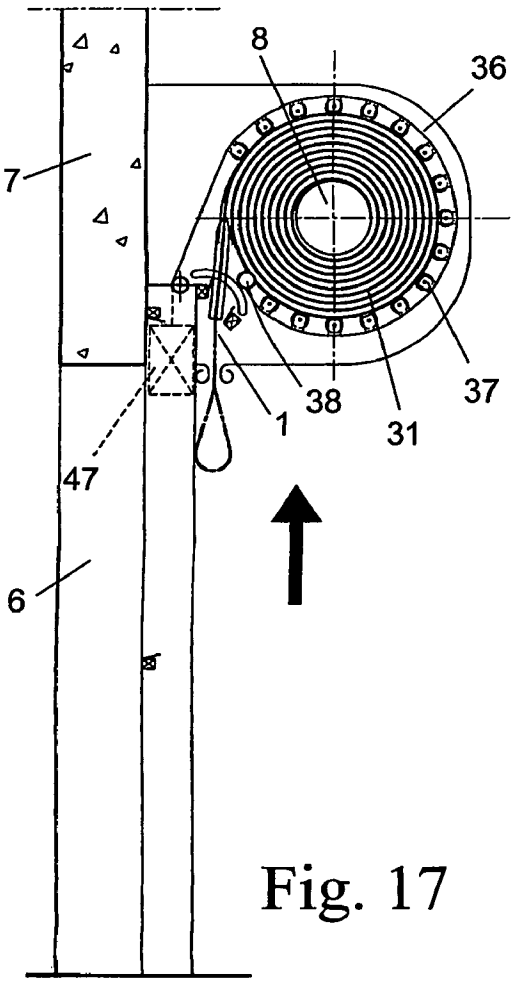
FIG. 17 is a schematic side view of a specific embodiment of the device proposed by the invention in which the shutter is in the open position.

FIGS. 17 to 19 illustrate a specific embodiment of the invention in which the confining means consist of a belt 36 at least partially enclosing the roll 31 formed by the shutter as it is wound onto the drum 8. This belt 38 applies a compression force to the roll 31 as the shutter 1 is being wound or unwound and has means which continually adapt the shape of the belt 36 to the diameter of the roll 31.

This belt 36 defines a guide surface, which enables the roll 31 to rotate about its axis, whilst the belt 36 bears with its guide surface on the roll 31.

The guide surface is provided in particular as a series of rollers 37 provided on the face of the belt 36 directed towards the roll 31. These rollers 37 enable the roll 31 to rotate about its axis whilst a pressing force is applied to the roll 31.

As a result of this pressing force and the friction which exists between the successive turns of the roll 31, the latter are not able to slip relative to one another. Furthermore, the formation of wrinkles is prevented as the shutter 1 is unwound.

One of the ends of the belt 36 is attached to a rod 38, which is located close to the roll 31, between the latter and the part of the shutter 1 which is not wound. This rod 38 can be displaced in a slit 39 extending radially relative to the axis of the drum 8. The belt 36 extends from this rod 38 around the roll 31 so that the part of the shutter 1 which has not been wound is located between the rod 38 and the belt 36.

A traction force is exerted on the other end of the belt 36. To this end, a weight 47 is attached to this other end, which can be vertically displaced along the guide tracks 2 and 3.

As the shutter 1 is unwound, the diameter of the roll 31 and hence its periphery become smaller. As a result, said weight 47 drops by a corresponding distance along the guide tracks 2 and 3. Under the action of this weight 47, the belt 36 remains taut and maintains a pressing force on the roll 31. At the same time, the rod 38 slides in said slit 39 and is held against the roll 31 by the traction force exerted on the other end of the belt 36.

Figure 21:
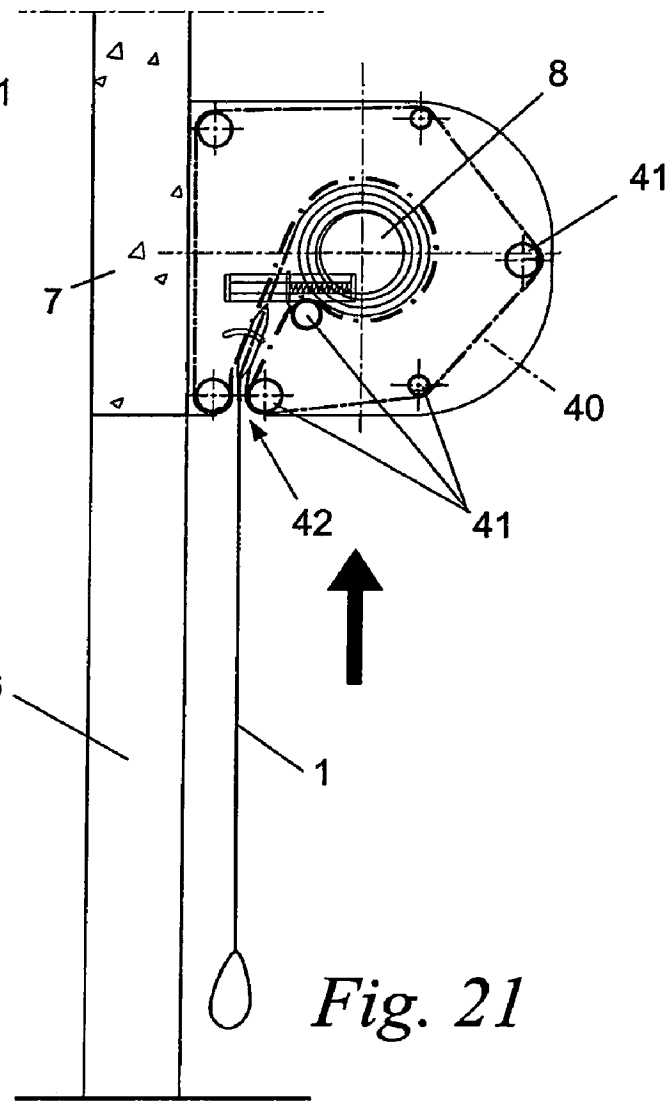
FIG. 21 is an identical view to that of FIG. 20 in which the shutter is in the closed position.
Figure 20:
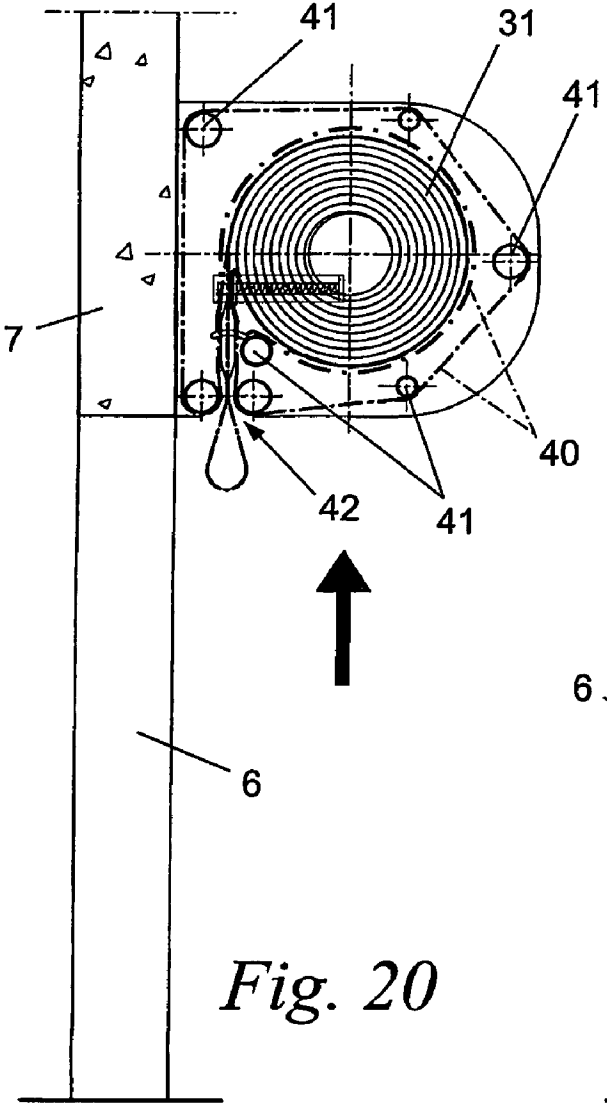
FIG. 20 is a schematic side view of one practical embodiment of the device proposed by the invention when the shutter is in the open position.

FIGS. 20 and 21 provide a very schematic illustration of another practical embodiment of the device proposed by the invention, in which a belt 40 looping back on itself co-operates with the roll 31.

The internal surface of this looping belt 40 is guided on the cylinders 41, which are disposed around and spaced at a certain distance from the roll 31. The axis of these cylinders extends substantially parallel with the axis of the drum 8.

The external surface of the belt 40 encloses the roll 31, preferably close to the side edges 2 and 3, and keeps the roll 31 tight by exerting a pressing force on it. A free space 42 is provided, through which the shutter 1 can be displaced towards the guide tracks 4 and 5 as it is being unwound.

As the shutter 1 is being wound or when it is unwound, by rotating the drum 8 about its axis, the belt 40, which is in contact with the outermost turn of the roll 31 is driven in displacement by the latter on the cylinders 41.

The belt 40 may be made from an elastic material, such as rubber for example, so that it can stretch as the diameter of the roll 31 increases during winding of the shutter 1 or can retract as the diameter becomes smaller when unwinding the shutter 1.

In another variant of this embodiment of the invention, one of the cylinders 41 on which the belt 40 is guided may mounted so that it can move and is linked to a spring, for example, to ensure that the belt 40 always remains taut. Accordingly, this moving cylinder is displaced as and when the diameter of the roll changes during winding or unwinding of the shutter 1.

Advantageously, the cylinder 41 which is located closest to the roll 31, in the space between it and the part of the as yet unwound shutter 1, may also be mounted so that it can move in order to hold this cylinder close to the roll 31 or bearing against it.

Figure 22:
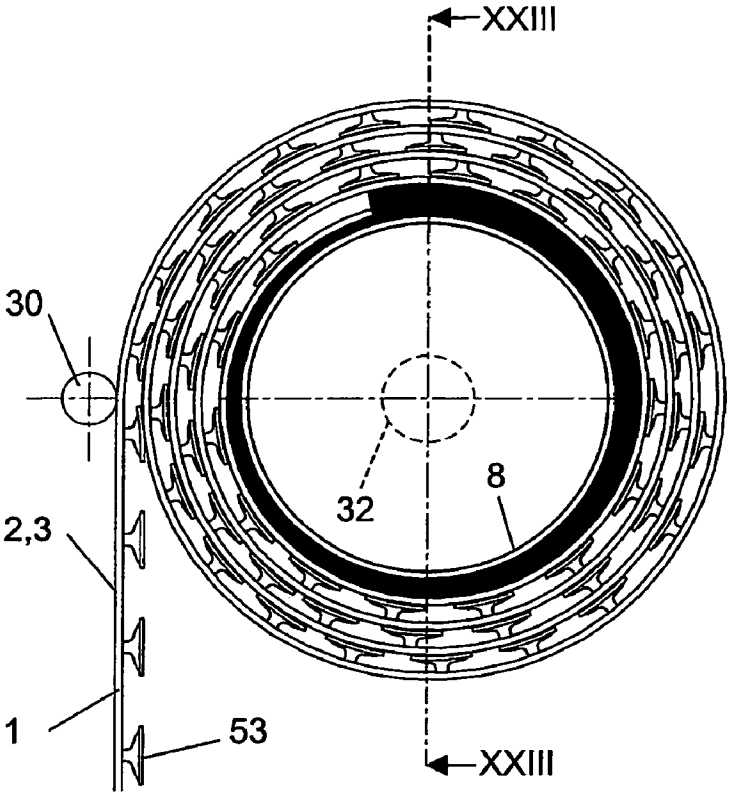
FIG. 22 is a schematic side view of another embodiment of a drum, around which a shutter is wound, proposed by the invention, in which the shutter is in the open position.
Figure 23:
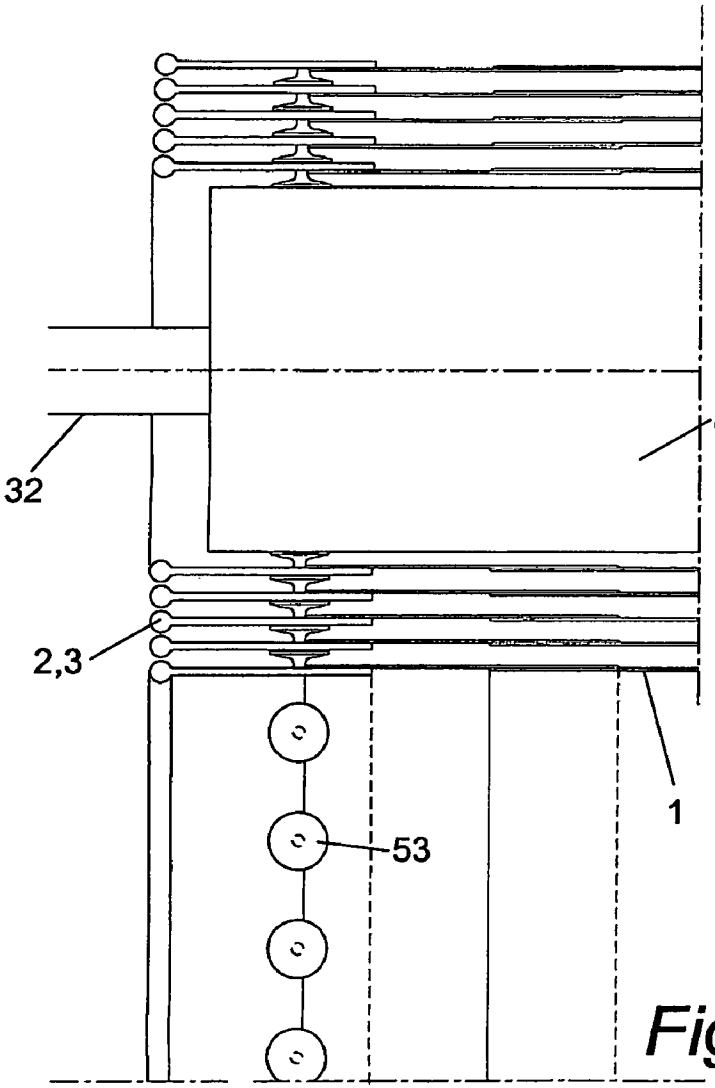
FIG. 23 is a section along the line XXIII-XXIII indicated in FIG. 22.

FIGS. 22 and 23 illustrate an embodiment of the shutter device proposed by the invention, in which the confining means comprise a succession of suckers 53 extending along the side edges 2 and 3 of the shutter 1. A pressing cylinder 30 is provided in the region where the unwound shutter is transformed in a roll 31 consisting of successive turns as the shutter 1 is wound. This cylinder 30 exerts a thrust force on the shutter in the region of the suckers 53 in order to adhere the latter to the outer face of the turn of the shutter 1 which has just been formed.

The shutter device, according to the invention, can comprises a shutter which is constituted of a succession of rigid lamellas 54 which are articulated one relative to the other. Such a shutter device is schematically represented in the FIGS. 24 and 25. In order to displace the shutter 1 towards its open position, the latter is being wound around a drum 8. The lamellas 54 of the shutter extend parallel with the axis of the drum 8.

Each lamella 54 is provided at each of its extremities with a tooth 55 extending transversally to the plane of the shutter 1 at one face of this latter. At the other face of the shutter 1 each lamella 54 is provided with a notch 56 so that, as the shutter is wound around the drum 8, the teeth 55 are engaged into the notches 56, thus forming a roll 31, the successive turns of which are fixed the one against the other and cannot slip relative to one another.

A pressing element 57 is provided which allows exerting a thrust force on the shutter 1 in the region where the turns are formed as the shutter 1 is opened and where the shutter 1 is unwound as the latter is closed.

It is possible to exert a thrust force on the lamellas 54 by means of the pressing element, as the shutter 1 is wound up, on the part of the shutter 1 wound around the roll 31 as the shutter 1 is opened so as to insert the teeth 55 of a turn which is formed in the matching notches 56 of the previously formed turn.

This pressing element 57 comprises two cylinders 58 and 59 being able to turn freely around their axis 60, which is parallel with the axis of the drum 8. A closed belt 61 is guided on the cylinders 58 and 59 while pressing on a part of the periphery of the roll 31. Said cylinders 58 and 59 are located at a certain distance the one to the other so that the belt 61 which is guided around the cylinders 58 and 59 presses on the roll 31.

Figure 25:
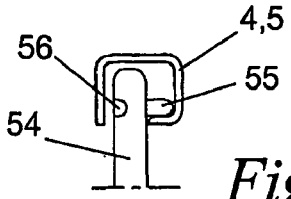
FIG. 25 is a section along the line XXV-XXV indicated in FIG. 24.

As illustrated in FIG. 25, the teeth 55 and, consequently, the notches 56, located in the part of the shutter 1, which is not wound, move in the corresponding guide tracks 4 or 5.

Figure 24:
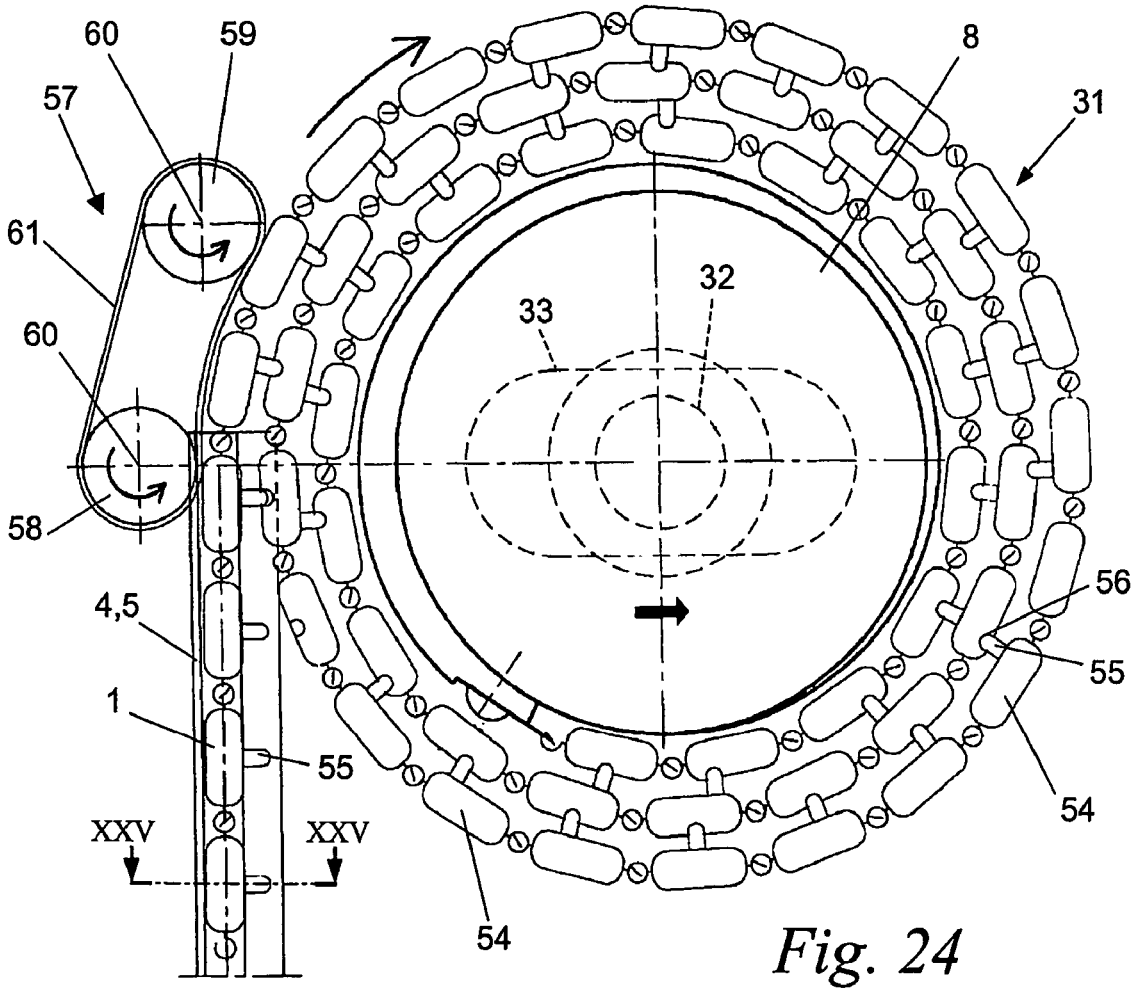
FIG. 24 is a cross-section of a roll made up of successive turns of a shutter with rigid lamellas articulated one about the other.

In order to maintain a contact between the roll 31 an d the belt 61, the shaft 32 of the drum 8 moves in a guide 33 extending along a direction perpendicular to the plane of the unwound-part of the shutter as the shutter is opened or closed. In particular, a spring, not shown in FIG. 24, is provided which exerts a pressing force onto the shaft 32 or onto the cylinders 58 and 59 and which allows maintaining a pressing force between the roll 31 and the belt 61.

Figure 26:
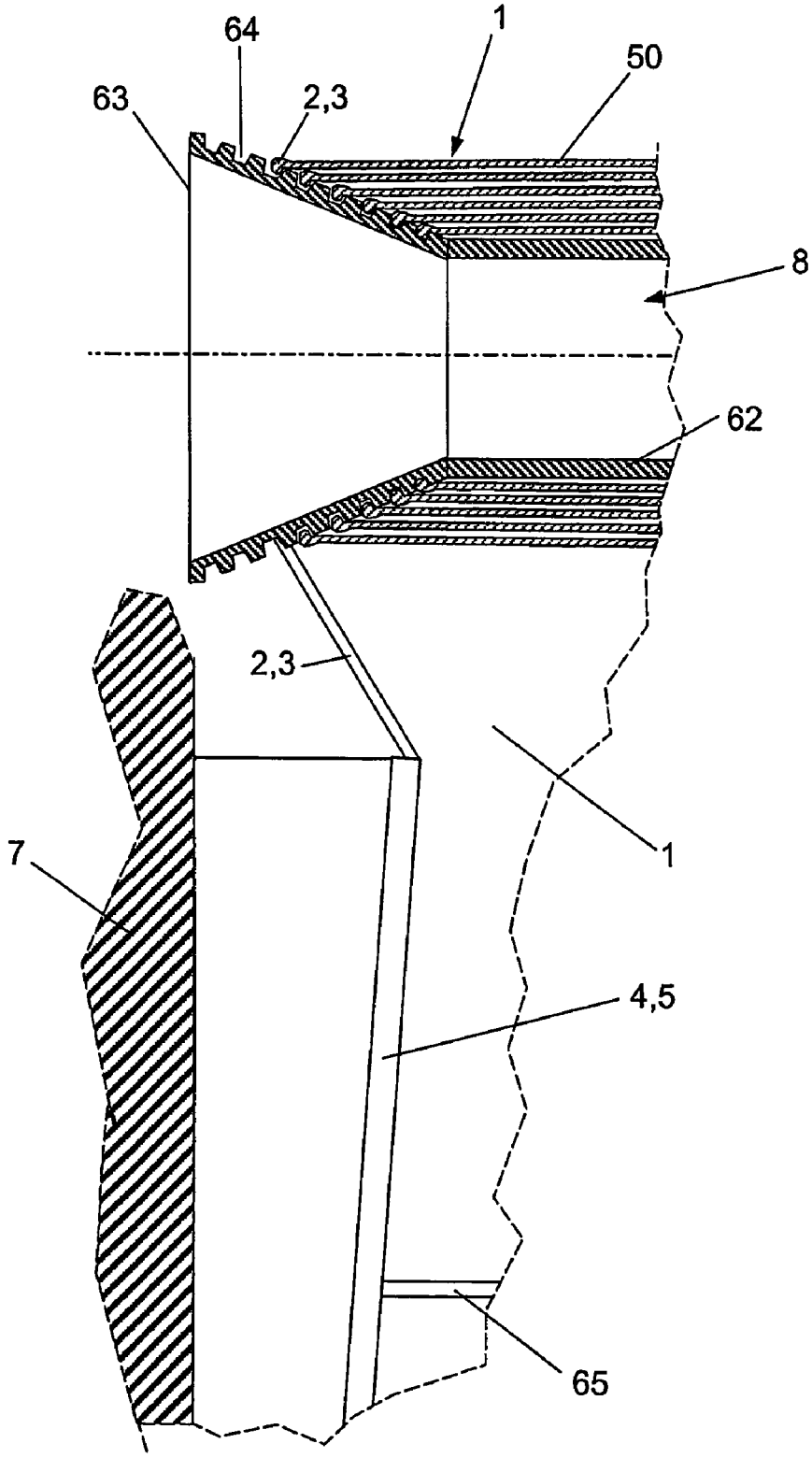
FIG. 26 is a longitudinal section of a drum around which a shutter is wound.

FIG. 26 illustrates a drum 8 around which a shutter 1, formed by a flexible canvas, is wound, the shutter having side edges 2 and 3 which are projecting with respect to the plane of the shutter 1 on the side of this latter directed towards the drum.

The drum 8 comprises a cylinder 62, the ends 63 of which are gored and thus having an essentially conical form. These conical ends 63 are provided with a notch 64 extending along a helix around their outer surface.

The shutter 1 preferably has a trapezoidal form so that the width of the shutter 1 in the region of the lower side 65 of the latter is larger then the width of the upper part of the shutter 1. Thus, the distance between the guide tracks 4 and 5 increases gradually from the upper end of the guide tracks 4 and 5 near the drum 8 to the lower end of these guide tracks 4 and 5.

This assures that, when the shutter 1 is in its closed position, the latter is almost perfectly tightened between the guide tracks 4 and 5. Moreover, as the shutter 1 is wound up, the successive turns formed around the drum 8 are also tightened so that the shutter is wound very compactly.

Figure 27:
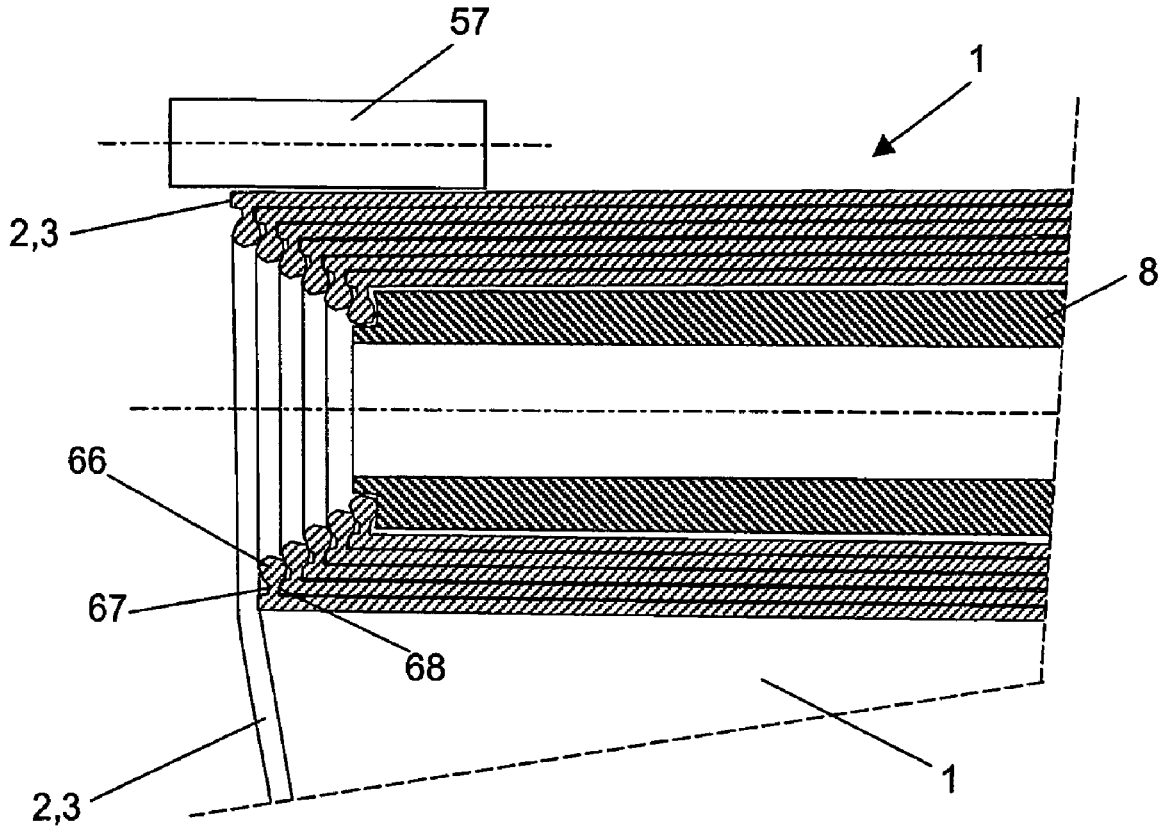
FIG. 27 is a longitudinal section of a drum around which a shutter is wound in a variation on the shutter device illustrated in FIG. 26.
Figure 28:
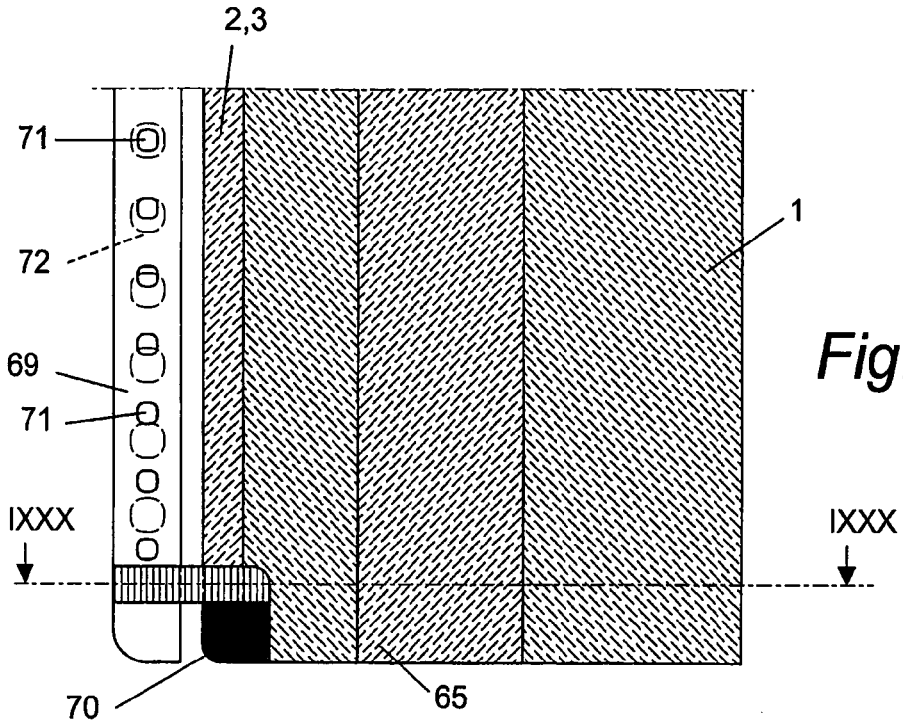
FIG. 28 is a schematic view of a part of a shutter with an incompressible component in an embodiment proposed by the invention.
Figure 29:
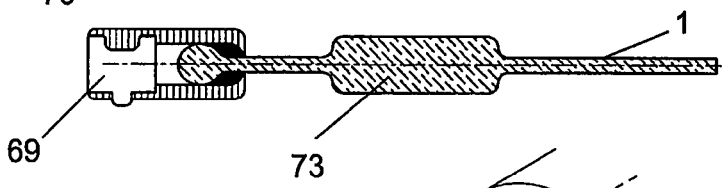
FIG. 29 is a schematic section along the line IXXX-IXXX indicated in FIG. 28.

FIG. 27 illustrates a variation on this last embodiment in which the successive turns of the shutter 1, wound around the drum 8, are fixed one against the other as the shutter is wound. To this end, the side edges 2 and 3 of the shutter 1 have a rib 66 extending transversally to the plane of the shutter 1. This rib is provided with a notch 67 and 68 at each of the side faces of the rib 66. Thus, as the shutter 1 is wound around the drum 8, this rib 66 extends beyond the preceding turn of the shutter 1 and grips into the notch 67 of the rib 66 of this preceding turn. In this way, the successive turns of the shutter 1 are fixed one against the other as the shutter 1 is wound.

In order to lead this rib 66 into the notch 67 of the rib of the preceding turn, a pressing element 57 is provided which is formed by a cylinder, the axis of which is preferably parallel to the axis of the drum 8. This cylinder presses on the side edge 2 or 3 of the part of the shutter 1 which is transformed in a turn in order to insert the rib 66 into the notch 67 of the preceding turn.

FIGS. 28 to 32 illustrate yet another embodiment proposed by the invention in which an oblong component 69 is provided extending along the side edge 2 or 3 of the shutter 1. This component 69 is incompressible in its longitudinal direction and leans on a projecting part 70 provided at the side edge 2 or 3 of the shutter 1.

Figure 30:
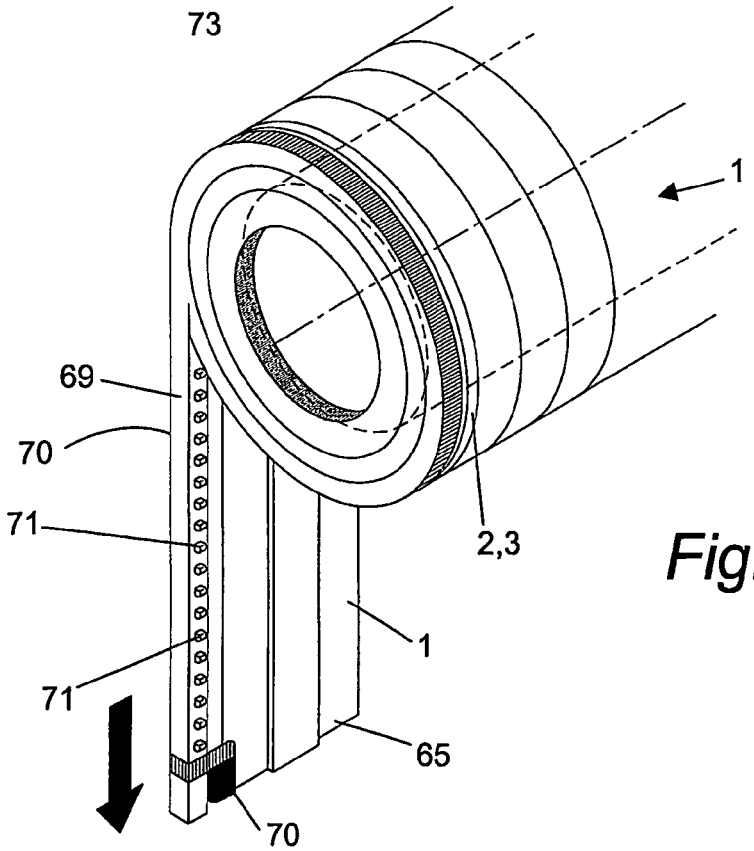
FIG. 30 is a view in perspective of the shutter as it is wound onto the drum in the embodiment illustrated in the FIGS. 28 and 29.
Figure 32:
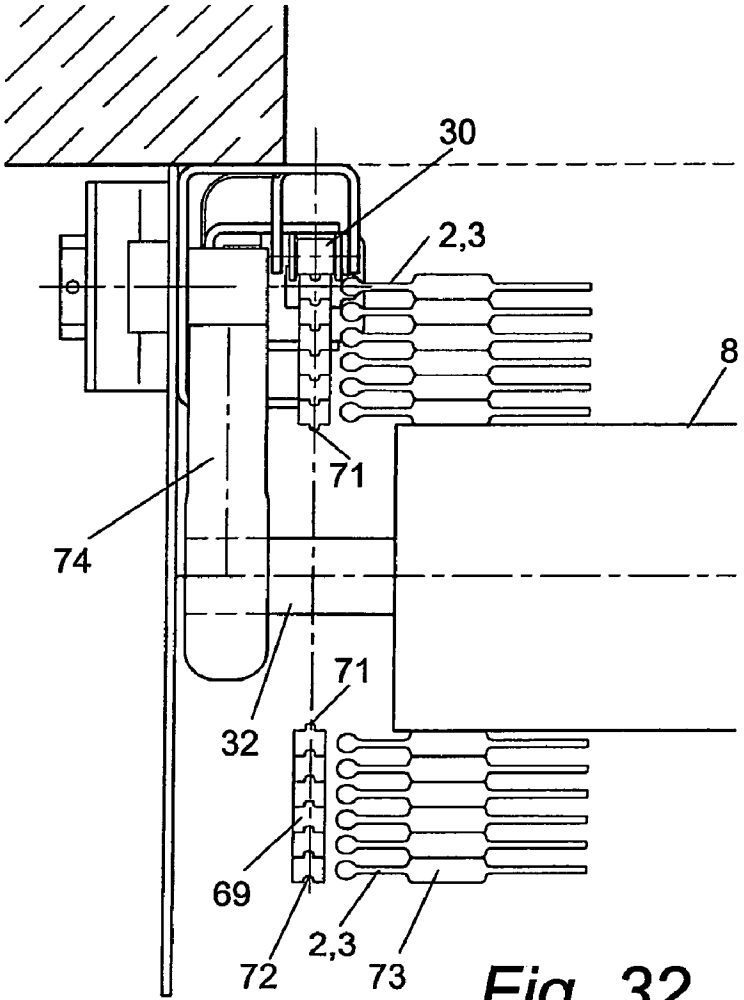
FIG. 32 is a section analogous to that of FIG. 31 in which the shutter is wound.
Figure 31:
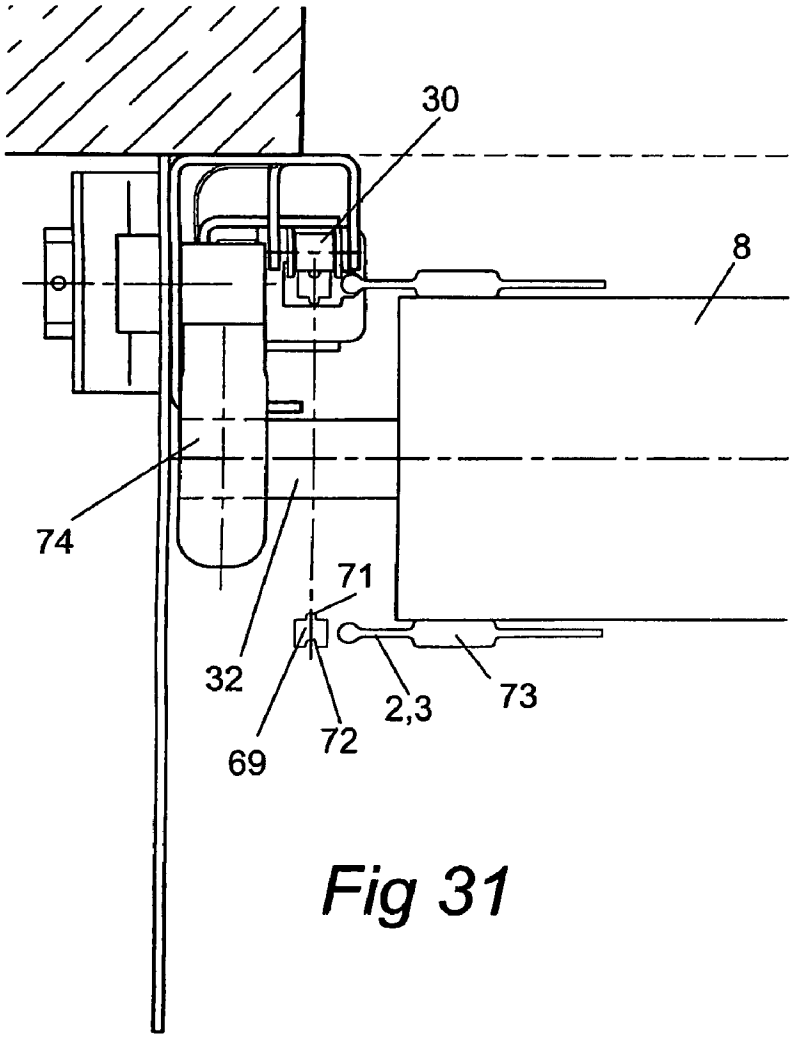
FIG. 31 is a horizontal section of the drum of which the shutter is unwound.

As the shutter 1 is opened, this component 69 is wound together with the shutter 1, forming successive turns as shown in FIGS. 30 and 32. In order to displace the shutter 1 towards its closed position, a thrust force is exerted on the component 69 along its longitudinal direction. The lower end of the component 69 acts on said projecting part 70, located near the lower edge 65 of the shutter 1.

The component 69 can be driven by the shaft 32 of the drum 8 or directly, for example, by an electric engine.

When the shutter 1 is in its open position, the incompressible component 69 is wound around the drum 8 forming layered turns. The component 69 is provided with hooking means to fix the successive turns one against the other so that, as the shutter 1 is unwound, for example, driven by the drum 8, a thrust force is exerted on the incompressible component 69 along its longitudinal direction.

The hooking means comprise, in particular, a succession of teeth 71 provided at one face of the component 69, whereas corresponding notches 72 are provided at the opposite face of this component 69. In this way, as the shutter 1 is wound, the successive turns, formed by the component 69 grip one into the other when the teeth 71 engage into the notches 72.

When a guide track is provided to guide the side edges 2 and 3 of the shutter 1, the incompressible component 69 is also displaced in these guide tracks as the shutter 1 is opened or closed.

This allows the side edges 2 and 3 to be released from the guide tracks as, for example, described in document EP 0272733 when a force is exerted on the shutter 1 in a direction transversal to the guide track. At the same time, said projecting part 70 is released from the component 69.

The shutter 1 has a thickening 73 extending along the shutter 1, the thickness of which, in a direction perpendicular to the plane of the shutter 1, essentially corresponds to the thickness of the incompressible component 69 in this direction. Thus, as the shutter 1 is opened, the roll formed by the shutter 1 and the roll formed as the component 69 is wound have the same diameter.

The incompressible component 69 can be constituted by a rod, made from a flexible material such as, for example, polyurethane strengthened with fiberglass or it can be formed by a Kevlar rod. It is equally possible to use a metal or synthetic chain, the links of which are provided with means to clutch at one another when the chain is wound.

A pressing cylinder 30 is provided in the region where the component 69 is wound to form said turns as the shutter 1 is opened. This cylinder 30 exerts a pressing force on the component 69 in order to engage the teeth 71 of the turn being formed into the notches 72 of the preceding turn.

The drum 8 is suspended at an end of a rotating arm 74, which is fixed with the other end at the wall above the cylinder 30. Thus, under the effect of the gravity, a thrust force is always present between the pressing cylinder 30 and the component 69.

It is clear that, in other embodiments proposed by the invention, one can provide hooking means which are described here above on the incompressible component in stead of fixing these hooking means on the plane of the shutter.

Clearly, the invention is not limited to the embodiments described above and illustrated in the drawings and other variants would be conceivable without departing from the scope of the invention.

For example, the hooking means may comprise a succession of permanent magnets extending in the longitudinal direction of the shutter and on one side thereof.

Although the confining means and hooking means of the different embodiments of the device proposed by the invention are located in the region close to the side edges 2 and 3 of the shutter 1, it would also be possible for these means to be provided substantially at the center between the side edges 2 and 3 or extend across the full width of the shutter 1.

Furthermore, the shutter device proposed by the invention is not restricted to doors with vertical guide tracks but may also have horizontal guide tracks, or guide tracks extending in whatsoever direction, for example if the shutter is used as a sun screen. In other situations, it would also be possible to provide only a horizontal guide track on the top end of a bay so that the shutter is suspended on this guide track or to provide no guide track at all.

Finally, the ribs can be made from a succession of projections extending at certain distances relative to one another.

The invention claimed is:

1. Shutter device with a shutter (1) and with driving means for displacing the shutter (1) between an open position and a closed position and comprising a drum (8) about which the shutter (1) is wound into its open position, whereby, in this open position, the shutter forms a roll (31) made up of turns of successive layers of the shutter (1), and from which drum (8) the shutter (1) can be unwound into its closed position, wherein the shutter device comprises confining means comprising hooking means (11) for holding successively turns tight one against the other as the shutter (1) is displaced into its closed position, wherein the hooking means are extending along the length of the shutter (1) and wherein at least one pressing element is provided for applying a thrust force to the hooking means (11) for fixing the successive turns of the roll (31) one to the other, whereby said thrust force is applied along a direction that is substantial radial to the drum (8).

2. Device as claimed in claim 1, wherein the hooking means (11) consist of a strip extending on one of the faces of the shutter (1) in the direction of its length and having at least one projection (12, 16, 21, 22, 23, 26, 27) which co-operates with the matching part on the other face of the shutter (1) such that said projection (12, 16, 21, 22, 23, 26, 27) grips with this part as the shutter (1) is being wound around the drum (8).

3. Device as claimed in claim 2, wherein said strip has at least one projection (12, 16, 21, 22, 23, 26, 27) on a face of the shutter (1), whereby this projection has one or more teeth (29) that matches in a recess (13, 17, 18, 24, 25, 28) on the other face of the shutter (1) when the shutter is wound around the drum (8).

4. Device as claimed in any one of claims 1, 2 or 3, wherein the hooking means (11) consist of a ribbon (14) with hooks extending on either side of the shutter (1), wherein hooks of one side of the shutter (1) grip onto hooks of the other side of the shutter (1) as the shutter is wound around the drum.

5. Device as claimed in claim 1, wherein the hooking means (11) consist of a notched belt (15) extending along the shutter (1), one of the sides of which is provided with a succession of teeth (16) and the other side of which has matching notches (17) which are such that, as the shutter (1) is being wound, the teeth (16) engage with the notches (17), preventing the successive layers of the shutter (1) thus formed in the roll (31) from slipping relative to one another.

6. Device as claimed in claim 5, characterized in that the distance between said teeth (16) or the dimensions thereof vary along the length of the shutter (1) in order to make allowance for the thickness of the shutter (1) and the increase in the diameter of the successive turns formed as the shutter (1) is wound.

7. Device as claimed in claim 1, wherein the pressing element and the drum (8) are mounted so as to be move relative to one another, means being provided to maintain a pressing force between the roll (31) and this pressing element.

8. Device as claimed in claim 1 or claim 7, wherein the pressing element has a rotating cylinder (30), the axis of which is substantially parallel with the axis of the drum (8).

9. Device as claimed in claim 1, wherein the confining means consist of a belt (36, 40) at least partially enclosing said roll (31), this belt (36, 40) exerting a pressing force on the roll (31), means being provided to adapt the shape of this belt (36, 40) to the diameter of the roll (31) as the shutter (1) is wound or unwound.

10. Device as claimed in claim 9, characterised in that said belt (36) defines a guide surface bearing on the roll (31) and enabling the roll (31) to move relative to the belt (36).

11. Device as claimed in claim 10, characterised in that said guide surface is provided in the form of a succession of rollers (37) fixed to the belt (36) and bearing on the outermost turn of the roll (31), these rollers rotating, preferably each about an axis parallel with that of the drum (8).

12. Device as claimed in any one of claims 9 to 11, characterised in that means (47) are provided to exert a traction force on one of the ends of the belt (36) so that at least a part of the latter extends along the contour of the roll (31) exerting a pressing force thereon as the shutter (1) is wound or unwound.

13. Device as claimed in any one of claims 9 to 11, characterised in that said belt (40) loops back on itself and is guided on cylinders (41) extending substantially parallel with the axis of the drum (8), said roll (31) being at least partially enclosed by the belt (40) which is in contact with the outermost turn of the roll (31) applying a pressing force thereto.

14. Device as claimed in claim 13, characterised in that at least one of said cylinders (41) is mounted so as to move relative to the drum (8) in order to adapt the shape of the belt (40) to the diameter of the roll (31) as the shutter (1) is being wound or unwound.

15. Device as claimed in claim 13, wherein said belt (40) is made from an elastic material.

16. Device as claimed in claim 1, wherein the shutter (1) cooperates with an incompressible oblong component cooperating directly or indirectly with the driving means of the shutter and extending along the side edge of the latter in the longitudinal direction of the shutter, this component, as the shutter is the closed, acting on a projecting part provided at this side edge.

17. Device as claimed in claim 16, characterised in that the incompressible component is wound around the drum when the shutter is in its open position forming superposed turns, the incompressible component being provided with hooking means to fix the successive turns one to the other such that a thrust force is applied on the incompressible component along its longitudinal direction as the shutter is unwound by driving the drum.

18. Device as claimed in claim 16 or 17, characterised in that said projecting part is provided at the lower end of the shutter.

19. Device as claimed in claim 18, wherein a guide track is provided relative to which the incompressible component is displaced as the shutter is opened or closed.

20. Device as claimed in claim 19, characterised in that the incompressible component and the corresponding side edge of the shutter are guided in said guide track, so that, when a force is exerted on the shutter in a direction transversally to the guide track, the side edge of the shutter is released from the corresponding side edge and from the corresponding incompressible component.

21. Device as claimed in claim 16, wherein the shutter has a thickening extending along the length of the shutter, the thickness of which in a direction perpendicular to the plane of the shutter essentially corresponds to the thickness of the incompressible component in that direction.

* * * * *